US009095249B2

(12) United States Patent
Domenech Grau

(10) Patent No.: US 9,095,249 B2
(45) Date of Patent: Aug. 4, 2015

(54) DISHWASHER TRAY

(71) Applicant: MIGUEL PUJADAS S.A., Santa Coloma De Farners (Girona) (ES)

(72) Inventor: Daniel Domenech Grau, Santa Coloma De Farners (ES)

(73) Assignee: MIGUEL PUJADAS, S.A. (ES)

( * ) Notice: Subject to any disclaimer, the term of this patent is extended or adjusted under 35 U.S.C. 154(b) by 0 days.

(21) Appl. No.: 14/253,867

(22) Filed: Apr. 16, 2014

(65) Prior Publication Data

US 2014/0224696 A1 Aug. 14, 2014

Related U.S. Application Data

(63) Continuation-in-part of application No. 13/639,622, filed as application No. PCT/IB2011/051485 on Apr. 6, 2011, now abandoned.

(30) Foreign Application Priority Data

Apr. 8, 2010 (ES) ..... 201030314 U

(51) Int. Cl.
*A47G 19/08* (2006.01)
*A47L 15/50* (2006.01)

(52) U.S. Cl.
CPC ..... *A47L 15/50* (2013.01)

(58) Field of Classification Search
CPC ..... A47L 15/501; A47L 15/50; B65D 85/305
USPC ..... 211/41.8, 41.9, 126.2–126.4, 126.7, 211/126.12; 108/61, 60, 27; 312/348.3, 312/311, 228.1
See application file for complete search history.

(56) References Cited

U.S. PATENT DOCUMENTS 1,524,960 A * 2/1925 Adams ..... 4/290
1,804,099 A 5/1931 Hazy (Continued)

FOREIGN PATENT DOCUMENTS

DE 1486511 A1 10/1969
DE 10052732 A1 5/2002

(Continued)

OTHER PUBLICATIONS

Weinberg,E,"International Search Report" for PCT/IB2011/051485, Oct. 27, 2011, Daniel Domenech Grau, 4 pages.

*Primary Examiner* — Joshua Rodden
*Assistant Examiner* — Kimberley S Wright
(74) *Attorney, Agent, or Firm* — Hess Patent Law Firm LLC; Robert J. Hess

(57) ABSTRACT

The dishwasher tray has a base module including a bottom wall and perimeter walls. The bottom wall has a grid on which table utensils are placed and a drag element intended to be engaged by a dragging member of a dishwasher when the base module is introduced in the dishwasher. The perimeter walls also have grids. The dishwasher tray further includes at least one side lid intended to be detachably mounted on at least one of the perimeter walls covering one grid of the perimeter wall. Optionally, the side lid comprises protrusions that snap fit in complementary cavities provided in the perimeter wall. Optionally the side lid is colored or marked according to a color or mark code identifying the content of the dishwasher tray and/or the grids of all the perimeter walls can be covered with corresponding side lids when the tray is used for storage of table utensils.

12 Claims, 5 Drawing Sheets

(56) References Cited

U.S. PATENT DOCUMENTS

| | | | | | |
|---|---|---|---|---|---|
| 2,111,780 | A | * | 3/1938 | Horton | 40/607.15 |
| 2,337,923 | A | | 12/1943 | Pierce | |
| 2,530,481 | A | | 11/1950 | Rawn, Jr. | |
| 2,718,325 | A | | 9/1955 | Dales | |
| 2,840,256 | A | * | 6/1958 | Cobb, Jr. | 220/4.26 |
| 2,908,985 | A | * | 10/1959 | Hartman | 40/324 |
| 2,974,818 | A | | 3/1961 | Rehrig | |
| 2,997,155 | A | | 8/1961 | Muckler et al. | |
| 3,050,073 | A | | 8/1962 | McMillan | |
| 3,099,585 | A | | 7/1963 | Kahn | |
| 3,203,557 | A | | 8/1965 | Ettlinger, Jr. | |
| 3,217,890 | A | * | 11/1965 | Maslow | 211/41.8 |
| 3,250,421 | A | | 5/1966 | Braun | |
| 3,252,582 | A | | 5/1966 | Kesilman et al. | |
| 3,283,915 | A | | 11/1966 | Maslow | |
| 3,367,529 | A | | 2/1968 | Mershon et al. | |
| 3,387,740 | A | * | 6/1968 | Bockenstette | 220/645 |
| 3,442,397 | A | * | 5/1969 | Irving et al. | 211/41.2 |
| 3,870,188 | A | * | 3/1975 | Buffett | 220/675 |
| 3,889,837 | A | * | 6/1975 | Wilson | 220/7 |
| 3,966,283 | A | | 6/1976 | Porch et al. | |
| 3,997,055 | A | | 12/1976 | Box | |
| 4,106,624 | A | * | 8/1978 | Thurman | 206/507 |
| 4,197,958 | A | * | 4/1980 | Zeni et al. | 220/675 |
| 4,353,470 | A | | 10/1982 | Polhemus et al. | |
| 4,373,627 | A | * | 2/1983 | Wood | 206/201 |
| 4,491,076 | A | | 1/1985 | Forshee | |
| 4,572,368 | A | * | 2/1986 | Miller et al. | 206/708 |
| 4,723,679 | A | | 2/1988 | Sinchok et al. | |
| 4,765,077 | A | * | 8/1988 | Rosenthal et al. | 40/308 |
| 4,775,050 | A | * | 10/1988 | Box | 206/507 |
| 4,993,554 | A | * | 2/1991 | Box | 206/507 |
| 5,285,900 | A | * | 2/1994 | Swingler | 206/508 |
| 5,803,277 | A | * | 9/1998 | Alvarez-Momoitio | 211/188 |
| D399,614 | S | * | 10/1998 | Goodin et al. | D32/3 |
| 5,934,486 | A | | 8/1999 | Jarvis et al. | |
| 5,967,356 | A | | 10/1999 | Laarhoven et al. | |
| 6,135,296 | A | | 10/2000 | Colgrove | |
| 6,634,510 | B2 | * | 10/2003 | Larson et al. | 211/41.8 |
| 6,726,031 | B2 | | 4/2004 | Laupan | |
| 7,048,134 | B1 | * | 5/2006 | Hagan | 220/6 |
| 7,441,673 | B2 | * | 10/2008 | McDade | 220/676 |
| 8,047,369 | B2 | * | 11/2011 | Stahl | 206/506 |
| 8,714,396 | B2 | * | 5/2014 | Hug | 220/528 |
| 2011/0253648 | A1 | * | 10/2011 | Clores | 211/41.2 |

FOREIGN PATENT DOCUMENTS

| | | | | | |
|---|---|---|---|---|---|
| EP | 1413242 | A1 | | 4/2004 | |
| EP | 1510464 | A1 | * | 3/2005 | B65D 1/48 |
| GB | 2419083 | A | | 4/2006 | |
| IT | EP0648463 | | * | 4/1995 | |
| JP | H05-74462 | | * | 10/1993 | |
| WO | WO 97/21599 | | | 6/1997 | |

* cited by examiner

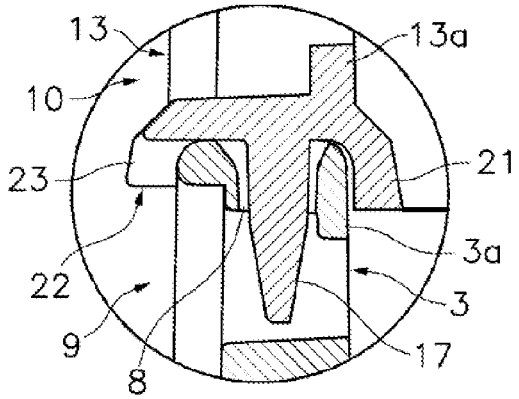
Fig.9
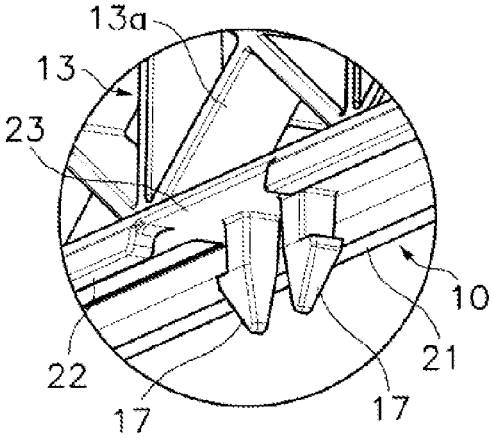
Fig.10
FIG. 11
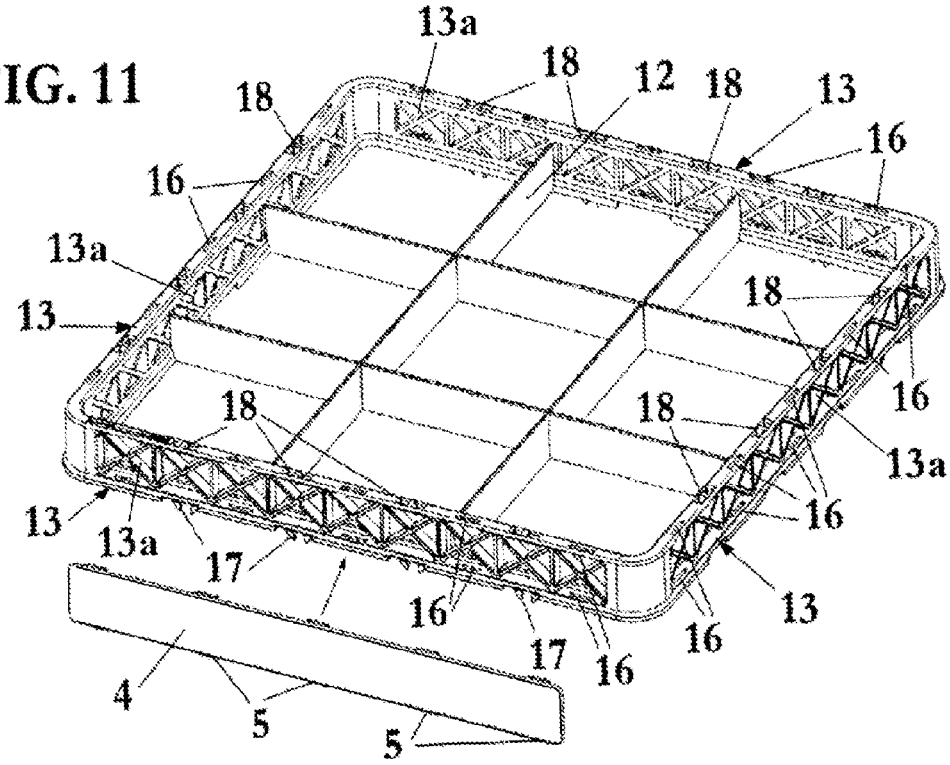

DISHWASHER TRAY

TECHNICAL FIELD

The present invention refers to a dishwasher tray for washing table utensils, e.g. cutlery, glasses, cups and the like in a dishwasher.

BACKGROUND OF THE INVENTION

Document U.S. Pat. No. 5,934,468 describes a dishwasher tray which is used for washing table utensils, such as e.g. cutlery, glasses, cups, etc., and which is also used as a support for storing said utensils typically after washing.

This dishwasher tray comprises a base module provided with a bottom having a grid on which said utensils are placed, and a drag element engageable by a dragging member of a dishwasher, and perimeter walls having grids.

The dishwasher tray further comprises at least one extender module including perimeter walls having grids and pairs of resilient harpoon-shaped prongs extending downwards from lower edges of the perimeter walls to snap fit in corresponding sockets formed in upper edges of the perimeter walls of the base module.

The grids of the bottom and perimeter walls of the base module and the grids of the perimeter walls of the extender module have the advantage of making the washing of the utensils located on the dishwasher tray easier.

However, the grids of the perimeter walls of the base module and the extender module also have the drawback of permitting dust and debris to enter inside the tray, when the tray is used for storage of the table utensils after washing.

On the other hand, the harpoon-shaped prongs have upwardly sloped barbs that engage with downwardly loped surfaces of the sockets, and they only can be displaced from their engagement within the sockets by squeezing them together and allowing them to be withdrawn by means of a tool introduced into a narrow space provided between two wall members of a double walled structure of the perimeter walls, which is a difficult and annoying operation.

Therefore, it is apparent there is a need for a dishwasher tray having a base module and optionally one or more extender modules that combines the advantages of having grids at their perimeter walls with the possibility of completely closing said grids in a simple and quick way, when the dishwasher tray is used for storing table utensils.

It is also apparent the need of a dishwasher tray having a base module and at least one extender module with grids at their perimeter walls and at least one side lid including an identifier intended to be releasably attached to one of the perimeter walls covering one of the grids.

It is also apparent the need of a dishwasher tray having a base module and at least one extender module where the extender module is able to be attached to and detached from the base module in an easy manner without the need of using specific tool.

DISCLOSURE OF THE INVENTION

With the dishwasher tray of the present invention the previous drawbacks can be solved, presenting other advantages that will be described.

The dishwasher tray of the present invention comprises a base module provided with a bottom having a grid on which said utensils are loaded and perimeter walls having grids. The bottom further includes a drag element intended to be engaged by a dragging member of a dishwasher that drags the base module loaded with table utensils along a path within the dishwasher. The base module of the dishwasher tray comprises in addition at least one side lid to be detachably mounted on at least one of said perimeter walls covering the grid of any one of said perimeter walls. Optionally, the dishwasher tray includes a number of side lids appropriate to cover the grids of all the perimeter walls of the base module.

This feature has several advantages. For example, the at least one side lid can be colored or marked according to a color or mark code identifying the content of the dishwasher tray, and additionally or alternatively can support any other graphic or written information, and/or all the grids of all the perimeter walls can be voluntarily covered in an easy way, e.g. for preventing the entrance of dust and debris therethrough when the dishwasher tray is used for storage. Therefore, benefits obtained when the dishwasher tray is used in the dishwasher and when it is used for storage with no deposit of dust and debris are combined. When used for storage, an upper opening of the dishwasher tray will be obviously covered with a top lid.

In one embodiment, the dishwasher tray further comprises at least one extender module comprising perimeter walls having grids. Both the base module and the or each extender module has sockets formed in upper edges of the perimeter walls thereof and the or each extender module has pairs of resilient prongs extending downwards from lower edges of the perimeter walls thereof to snap fit in the corresponding sockets of the base module or of another analogous extender module. At least one side lid can also be detachably mounted on any one of said perimeter walls of the extender module to cover the corresponding grid, or the grids of all the perimeter walls can be covered with corresponding side lids.

One or more of said extender modules are used to provide the perimeter walls of the dishwasher tray with a height adapted to the height of the table utensils to be contained therein. For example, for table utensils having a low height, such as cutlery, only the base module with no extender modules could be enough, and for table utensils having a higher height, such as cups or dishes, one or more extender modules stacked on and attached to the base module could be necessary.

Advantageously, each side lid comprises resilient protrusions that snap fit inside complementary cavities provided in said base module and in said extender module, if any, of the dishwasher tray, so that the side lid can be placed and removed easily. Furthermore, the side lid is mounted preferably on the external part of said perimeter wall of the base module or the extender module.

If wished, a plurality of dishwasher trays of the present invention can be stacked on top another, with each dishwasher tray comprising only the base module or the base module and one or more extender modules engaged to each other. In this case, by placing a side lid on each grid of each perimeter wall of each dishwasher tray in combination with said top lid placed on top of the upper dishwasher tray the entrance of dust and debris is prevented in all the stacked dishwasher trays.

BRIEF DESCRIPTION OF THE DRAWINGS

The previous and other features and advantages will be more fully understood from the following detailed description of non-limiting exemplary embodiments with reference to the accompanying drawings, in which:

FIG. 9 is a partial cross sectional view taken along the plane IX-IX of FIG. 8;

FIG. 10 is a partial perspective view showing a detail of a lower edge of a perimeter wall of the extender module of FIG. 2; and FIG. 11 is a perspective view of an extender module according to another embodiment of the present invention.

DETAILED DESCRIPTION OF PREFERRED EMBODIMENTS

Figure 1:
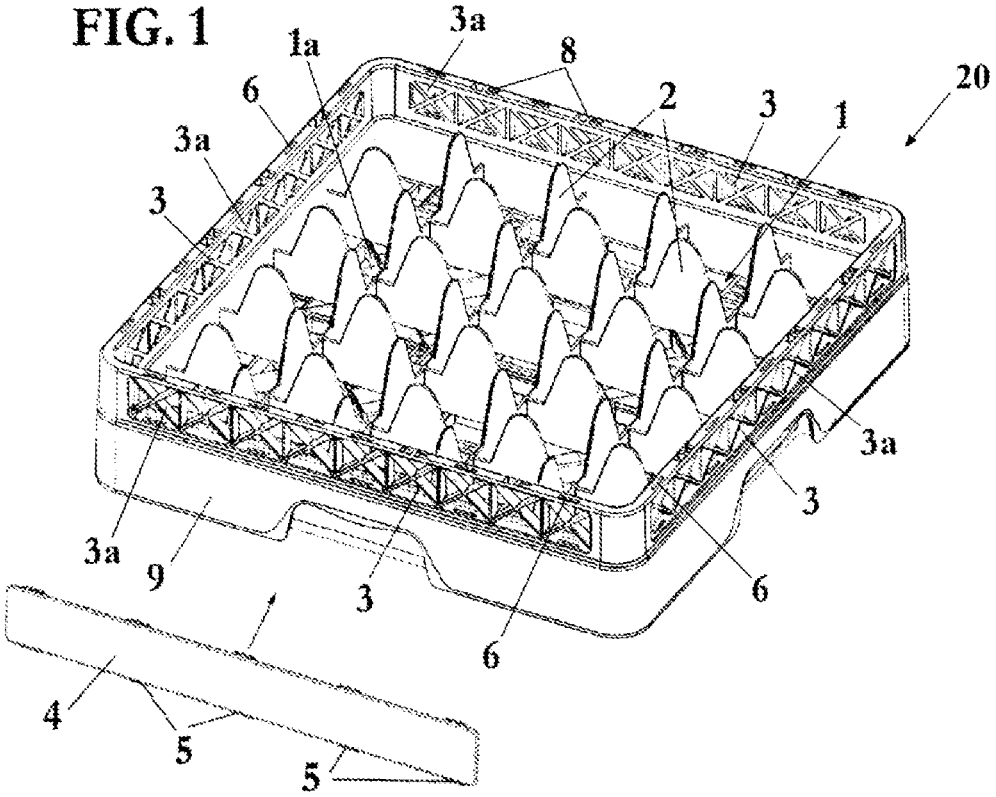
FIG. 1 is a perspective view of a base module of a dishwasher tray according to an embodiment of the present invention, with a side lid removed from the base module.

Referring first to FIG. 1, the reference sign 20 designates a dishwasher tray according to an embodiment of the present invention, which comprises a base module 9 provided with a bottom 1 having a grid la on which table utensils (not shown) are placed in use, and perimeter walls 3 having grids 3*a*.

The bottom 1 (better shown in FIG. 4) further comprises a drag element 1*b* configured to engage a dragging member of a dishwasher when the dishwasher tray 20 loaded with table utensils is introduced in the dishwasher for washing the table utensils. The drag element 1*b* comprises two longitudinal webs extending from one another of two opposite perimeter walls 3 of the base module 9 and a plurality of transverse webs connected at their ends to said longitudinal webs. In use, the dishwasher tray is introduced into the dishwasher with the longitudinal webs oriented parallel to a forward movement direction of the dragging member of the dishwasher.

Figure 4:
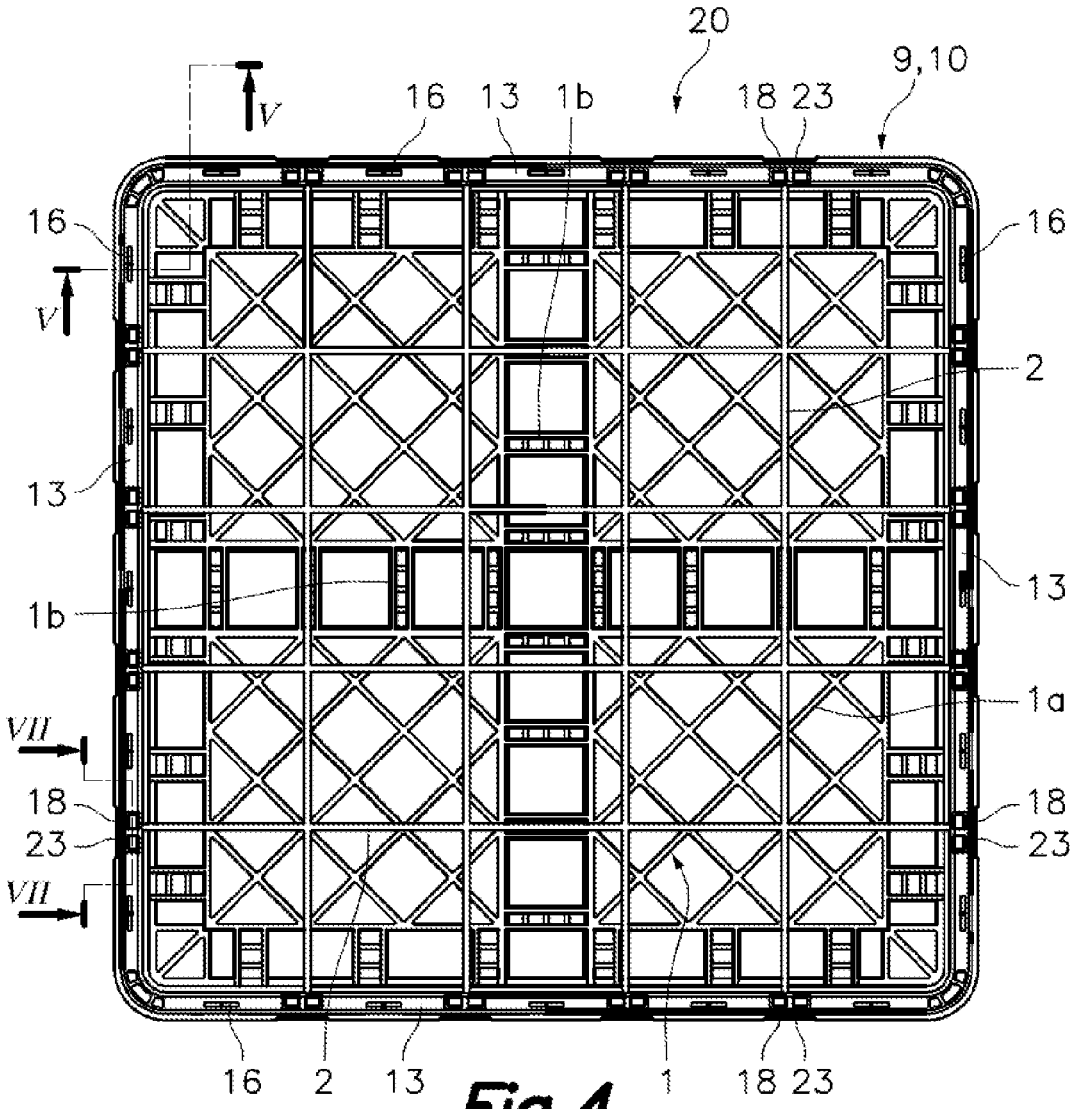
FIG. 4 is a plan view of the dishwasher tray of FIG. 3.

In the embodiment shown in FIGS. 1 and 4, the dishwasher tray is square-shaped and has two of said drag elements 1*b* crossing one another at the center of the bottom 1, such that one of the two drag elements 1*b* always engages the dragging member of the dishwasher irrespective of the orientation of the dishwasher tray 20 in the dishwasher.

Optionally, the bottom 1 further comprises separators 2 in the form of partition walls used to organize the table utensils in the dishwasher tray for washing and/or storing them. In the embodiment shown in FIG. 1, the base module 9 includes two groups of four intercrossing separators 2 defining twenty-five substantially square compartments. The number and arrangement of the separators 2 depends on the number and shape of the table utensils to be loaded to the dishwasher tray 20.

The grids 1*a*, 3*a* define a plurality of holes in the bottom 1 and in the perimeter walls 3, said grids 1*a*, 3*a* making the washing of the table utensils easier when the dishwasher tray is used in a dishwasher.

According to the invention, the dishwasher tray further comprises at least one side lid 4 that can be detachably engaged on any one of the perimeter walls 3 of the base module 9 covering one of the grids 3*a*, so that said side lid 4 can be attached to and removed from the perimeter wall 3 at any time when desired.

Even though in FIG. 1 only one side lid 4 has been shown for simplicity reasons, the base module 9 according to the shown embodiment preferably comprises four side lids 4, one for each perimeter wall 3. Therefore, the grids 3*a* of said perimeter walls 3 are covered completely when the four side lids 4 are attached to the four perimeter walls 3.

The dishwasher tray 20 of the present invention can be formed by modules stackable one on each other. Therefore, in FIG. 1 a dishwasher tray 20 comprising only the base module 9 as described above is shown, in FIG. 2 an extender module 10 is shown alone, and in FIG. 3 a dishwasher tray 20 comprising the base module 9 of FIG. 1 and the extender module 10 of FIG. 2 stacked on and attached to the base module 9 is shown.

Figure 2:
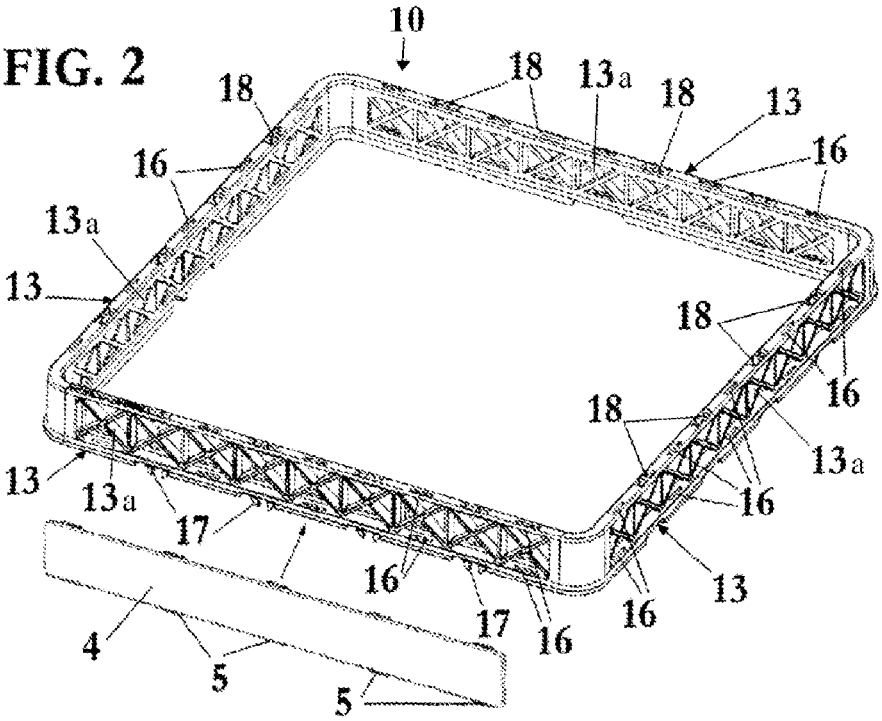
FIG. 2 is a perspective view of an extender module intended to be optionally stacked on and attached to the base module of FIG. 1, with a side lid removed from the extender module.

The extender module 10 shown in FIG. 2 comprises perimeter walls 13 having grids 13*a*, and has no bottom wall. The extender module 10 further comprises at least one side lid 4 that can be detachably engaged on any one of the perimeter walls 13 of the base module 9 covering one of the grids 13*a*, so that the side lid 4 can be attached to and removed from the perimeter wall 13 when desired.

Advantageously, the grids 13*a* of the perimeter walls 13 of the extender module 10 have the same dimensions as the grids 3*a* of the perimeter walls 3 of the base module 9 and the side lid 4 of the base module 9 and the side lid 4 of the extender module 10 are identical and interchangeable. The extender module 10 shown in FIG. 2 has no separators. However, the extender module 10 shown in FIG. 2 could have separators in a number and arrangement equivalent to the separators 2 of the base module 9 of FIG. 1.

Even though in FIG. 2 only one side lid 4 has been shown for simplicity reasons, the extender module 10 according to the shown embodiment preferably comprises four side lids 4, one for each perimeter wall 13. Therefore, the grids 13*a* of said perimeter walls 13 are covered completely when the four side lids 4 are attached to the four perimeter walls 13.

Figure 3:
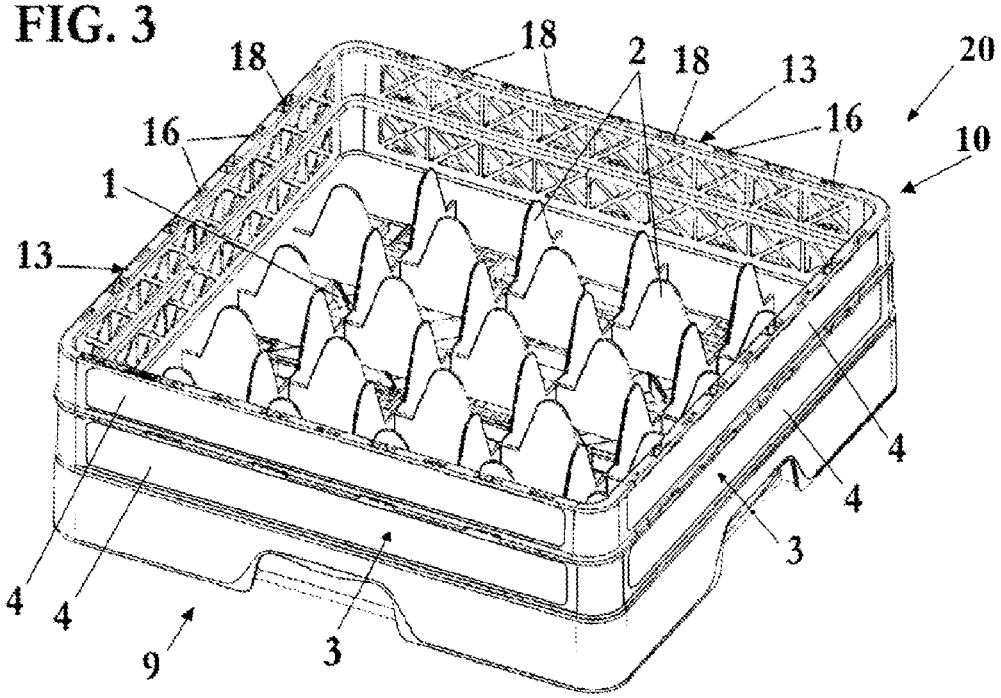
FIG. 3 is a perspective view of a dishwasher tray comprising the base module of FIG. 1 and the extender module of FIG. 2 attached to one another, and side lids attached to the base module and to the extender module.

FIG. 3 shows a dishwasher tray according to the present invention comprising one base module 9, one extender module 10 stacked on and attached to the base module 9, and eight side lids 4, four of which attached to the perimeter walls 3 of the base module 9 covering the grids 3*a* of all the perimeter walls 3 of the base module 9 and the other four attached to the perimeter walls 13 of the extender module 10 covering the grids 13*a* of all the perimeter walls 13 of the extender module 10.

Figure 5:
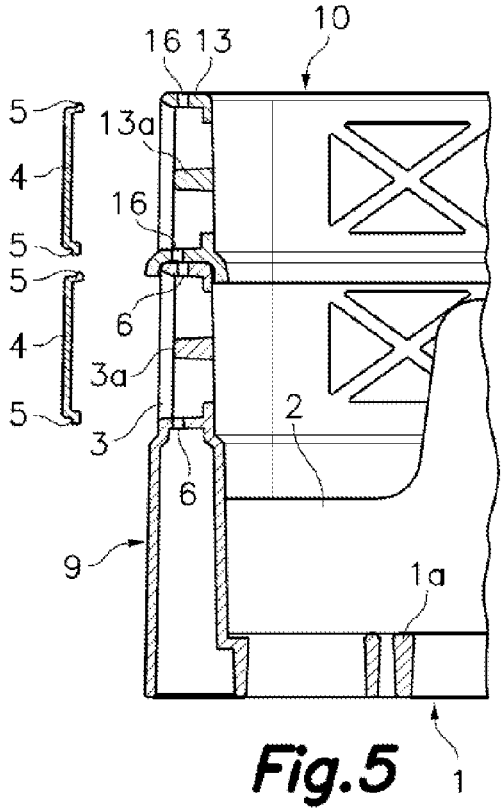
FIG. 5 is a partial cross sectional view taken along the plane V-V of FIG. 4 with side lids removed from the base module and the extender module.
Figure 6:
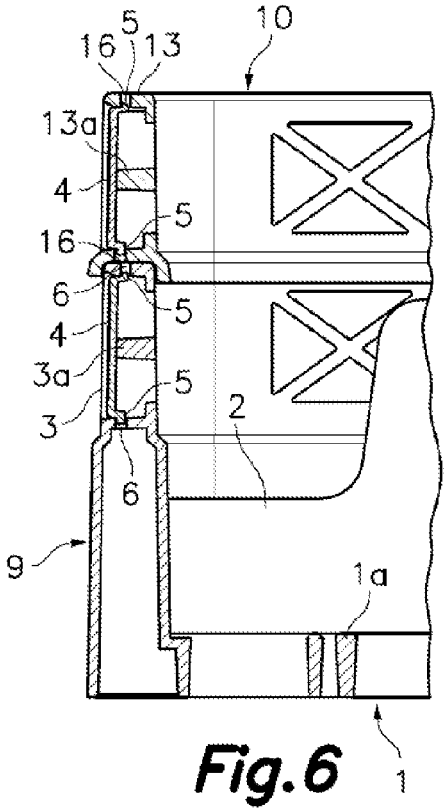
FIG. 6 is a partial cross sectional view similar to FIG. 5 with the side lids attached to the base module and the extender module.

As better shown in FIGS. 5 and 6, the engagement between each side lid 4 and the perimeter wall 3 of the base module 9 and the perimeter wall 13 of the extender module 10 is done advantageously on the external part of the perimeter wall 3, 13 by means of resilient protrusions 5 provided on the side lid 4 that snap fit inside complementary cavities 6, 16 provided in the corresponding perimeter wall 3, 13. In the shown embodiment, said cavities 6, 16 are formed in substantially horizontal flat upper and lower members of the grids 3*a*, 13*a* of the perimeter walls 3, 13 of the base module 9 and the extender module 10.

As shown in FIGS. 1 and 2, the mentioned protrusions 5 of the side lid 4 are distributed uniformly along opposite upper and lower edges of the side lid 4. In accordance (see also FIG. 4), the complementary cavities 6, 16 of the base module 9 and the extender module 10 are distributed uniformly along the corresponding flat upper and lower members of the grids 3*a*, 13*a* of the perimeter walls 3, 13 of the base module 9 and the extender module 10.

The extender module 10 further includes pairs of resilient prongs 17 extending downwards from lower edges of the perimeter walls 13. The perimeter walls 13 of the extender module 10 have the same shape (when viewed in plan view) as the perimeter walls 3 of the base module 9, and the pairs of resilient prongs 17 of the extender module 10 are shaped and arranged to snap fit in corresponding sockets 8 formed in the perimeter walls 3 of the base module 9.

The extender module 10 further comprises sockets 18 analogous to the sockets 8 of the base module 9. Said sockets 18 of the extender module 10 are located in the upper edges of the perimeter walls 13 of the extender module 10 at the same positions than the sockets 8 of the base module 9 are located in the perimeter walls 3 thereof, so that one extender module 10 can be stacked on and attached either to a base module 9 or to another extender module 10, and any number of extender modules 10 stacked on and attached to one another can be stacked on and attached to one base module 9.

The pairs of prongs 17 are distributed along the lower edges of the perimeter walls 13 of the extender module 10 and the sockets 8, 18 are distributed at corresponding positions along upper edges of the perimeter walls 3, 13 of the base module 9 and the extender module 10, as shown in FIG. 4.

Figure 7:
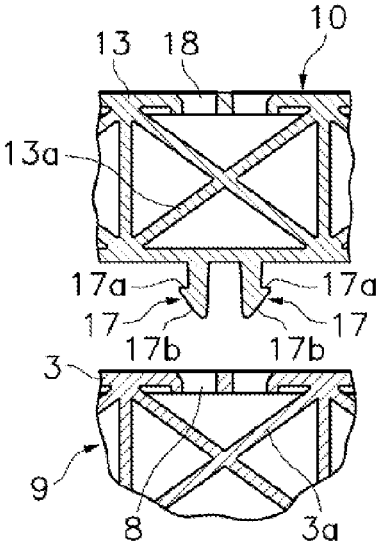
FIG. 7 is a partial cross sectional view taken along the plane VII-VII of FIG. 4 with the extender module detached from the base module.
Figure 8:
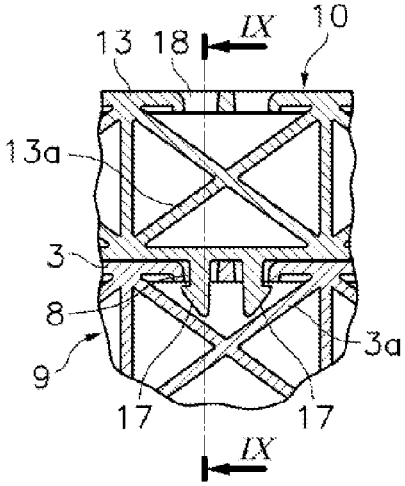
FIG. 8 is a partial cross sectional view similar to FIG. 7 with the extender module once coupled to the base module.

As shown in FIGS. 7, 8 and 10, said prongs 17 comprise opposite side projections having respective horizontal proximal surfaces 17*a* and respective inclined distal surfaces 17*b* converging from free ends of the horizontal proximal surfaces 17*a* to distal ends of the prongs 17.

When pressing the pairs of prongs 17 into the sockets 8, the prongs 17 of each pair are elastically deformed towards one another by the action of outer edges 8*a* of the socket 8 on the inclined distal surfaces 17*b* of the prongs 17 and then the prongs 17 expand in the socket 8 once the projections of the prongs 17 have passed beyond inner edges 8*b* of the socket 8 (FIG. 8).

As shown in FIGS. 9 and 10, inner and outer longitudinal rims 21, 22 extend downwards from the flat lower members of the grids 13*a* of the extender module 10 and the flat upper members of the grids 3*a* of the base module 9 are received between said inner and outer longitudinal rims 21, 22 when the extender module 10 is coupled to the base module 9.

The outer longitudinal rim 22 has interruptions 23 preferably in positions coinciding with the prongs 17.

The extender module 10 can be detached from the base module 9 by using any appropriate common object, for example one of the table utensils, such as a spoon, inserted in said interruption 23 to pry between the extender module 10 and the base module 9 so as to readily perform withdrawal of the prongs 17 from the sockets 8. Thus, the extender module 10 is detached from the base module 9 without using specific tools.

Additionally, as shown in FIG. 8, when the extender module 10 is stacked on and attached to the base module 9 or to another extender module 10, each pair of prongs 17 is accessible through one of the holes defined by the grid 3*a* of the base module 9 or the grid 13*a* of the another extender module 10, so that the prongs 17 of each pair can be manually elastically deformed towards one another in combination with the use of the mentioned appropriate common object.

When a base module 9 an one or more extender modules 10 are stacked and attached to one another, side lids 4 are placed covering all the grids 3*a*, 13*a* of all the perimeter walls 3, 13, and a top lid (not shown) is placed to cover an upper aperture of the upper extender module 10, the dishwasher tray 20 remains completely closed, preventing the entrance of dust and debris from outside when the dishwasher tray 20 of the present invention is used for storing the table utensils.

Furthermore, at least one of the side lids 4 can be colored or marked according to a color or mark code identifying the content of the dishwasher tray, or can support any other graphic or written information.

FIG. 11 shows another embodiment of the extender module 10 which is identical to the extender module 10 described above with reference to FIG. 2 except in that here the extender module 10 further includes separators 12 in the form of partition walls in register with separators 2 of a corresponding base module (not shown). In the embodiment shown in FIG. 11, the extender module 10 includes two pairs of intercrossing separators 12 defining nine substantially square compartments and accordingly the corresponding base module (not shown) would also have two pairs of intercrossing defining nine analogous compartments.

As stated previously, with the dishwasher tray of the present invention it is possible to combine the advantages of having grids present in the perimeter walls of the base module and extender modules (when the dishwasher tray is used in a dishwasher) and the advantages of closing the grids of the perimeter walls in an easy and quick way when desired (when the dishwasher tray is used for storing table utensils).

Even though reference is made to specific embodiments of the invention, it is apparent for a person skilled in the art that the disclosed dishwasher tray is susceptible of numerous variations and modifications, and that all the details cited can be substituted by other technically equivalent ones, without departing from the scope of protection defined by the attached claims.

The invention claimed is:

1. A dishwasher tray comprising:

a base module;

at least one extender module stacked on and detachably attached to said base module, the base module including a bottom wall and perimeter walls, said bottom wall having a grid on which table utensils can be placed and a drag element that is engaged by a dragging member of a dishwasher when the base module is introduced in the dishwasher, said perimeter walls having grids; and a plurality of side lids detachably mounted on the perimeter walls completely covering all the grids of all the perimeter walls, the perimeter walls of said base module comprise cavities formed in members of the grids, said side lids comprise resilient protrusions that snap fit inside said cavities; said at least one extender module comprising perimeter walls having grids, and side lids detachably mounted on said perimeter walls of the extender module completely covering all the grids of the perimeter walls, wherein the perimeter walls of said extender module comprise cavities formed in members of the grids and the side lids comprise protrusions that snap fit in said cavities, said plurality of side lids preventing the entrance of dust and debris trough the grids of the perimeter walls when the dishwasher tray is used for storage.

2. The dishwasher tray according to claim 1, wherein said cavities are formed in flat upper and lower members of the grids of the perimeter walls of the base module.

3. The dishwasher tray according to claim 1, wherein at least one of the plurality of side lids is colored or marked according to a color or mark code identifying content of the dishwasher tray.

4. The dishwasher tray according to claim 1, wherein at least one of the plurality of side lids includes graphic or written information.

5. The dishwasher tray according to claim 1, wherein said plurality of side lids are mounted on an external part of said perimeter walls.

6. The dishwasher tray according to claim 1, wherein at least one of the side lids of the extender module is colored or marked according to a color or mark code identifying the content of the dishwasher tray.

7. The dishwasher tray according to claim 1, wherein at least one of the side lids of the extender module includes graphic or written information.

8. The dishwasher tray according to claim 1, wherein the extender module comprises pairs of resilient prongs extending downwards from lower edges of the perimeter walls of the extender module to snap fit in corresponding sockets formed in the perimeter walls of the base module when the extender module is stacked on and attached to the base module.

9. The dishwasher tray according to claim 8, wherein said prongs of each pair have respective horizontal proximal surfaces and respective inclined distal surfaces converging from free ends of the horizontal proximal surfaces to distal ends of the prongs.

10. The dishwasher tray according to claim 9, wherein the extender module further comprises sockets formed at upper edges of the perimeter walls thereof, said sockets being analogous to the sockets of the base module and being placed in analogous positions than the sockets of the base module, the pairs of prongs snap fitting in said sockets of another analogous extender module when the extender module is stacked on and attached to said another analogous extender module.

11. The dishwasher tray according to claim 10, wherein the extender module has inner and outer longitudinal rims that extend downwards from flat lower members of the grids of their perimeter walls and the grids of the perimeter walls of the base module or of another analogous extender module have flat upper members that are received between said inner and outer longitudinal rims when the extender module is stacked on and attached to the base module or to said another analogous extender module, said outer longitudinal rim having interruptions in positions coinciding with the pairs of prongs.

12. The dishwasher tray according to claim 10, wherein each pair of prongs is accessible through one hole of a plurality of holes defined by the grids of the perimeter walls of the base module or of another analogous extender module when the extender module is stacked on and attached to the base module or to said another analogous extender module.

* * * * *